US006988839B1

(12) United States Patent
Yu

(10) Patent No.: US 6,988,839 B1
(45) Date of Patent: Jan. 24, 2006

(54) MULTIPLE PAGE-RANGE PRINTER SETTINGS

(75) Inventor: Zhongming Yu, Redwood City, CA (US)

(73) Assignee: Ricoh Company, Ltd., Tokyo (JP)

( * ) Notice: Subject to any disclaimer, the term of this patent is extended or adjusted under 35 U.S.C. 154(b) by 278 days.

(21) Appl. No.: 09/823,803

(22) Filed: Mar. 30, 2001

(51) Int. Cl.
*B41J 11/44* (2006.01)

(52) U.S. Cl. ..... 400/76; 400/70; 400/61

(58) Field of Classification Search ..... 400/61, 400/70, 76; 715/525
See application file for complete search history.

(56) References Cited

U.S. PATENT DOCUMENTS

| | | | | |
|---|---|---|---|---|
| 4,475,806 | A * | 10/1984 | Daughton et al. | 399/81 |
| 5,384,620 | A * | 1/1995 | Ebner et al. | 399/1 |
| 5,448,691 | A * | 9/1995 | Motoyama | 715/525 |
| 5,579,087 | A * | 11/1996 | Salgado | 399/1 |
| 5,594,840 | A * | 1/1997 | Sahay et al. | 358/1.14 |
| 5,930,465 | A * | 7/1999 | Bellucco et al. | 358/1.15 |
| 6,233,414 | B1 * | 5/2001 | Farrell | 399/81 |
| 2002/0101608 | A1 * | 8/2002 | Whitmarsh | 358/1.15 |

FOREIGN PATENT DOCUMENTS

JP 06266187 A * 9/1994

JP 2004010324 A * 1/2004

OTHER PUBLICATIONS

S. Strasen, et al., "ISO/IEC 10180 Information Technology-Text Communication-Standard Page Description Language (SPDL)", Dec. 30, 1993, SPDL Project Editors, pp. 11-1, 13-2 - 13-5.

* cited by examiner

*Primary Examiner*—Charles H. Nolan, Jr.
(74) *Attorney, Agent, or Firm*—Hickman Palermo Truong & Becker, LLP

(57) ABSTRACT

A method and system for printing an electronic document is disclosed. In one aspect, a first media type for printing a first page range of one or more pages of an electronic document is selected. A second media type for printing a second page range of one or more pages of the electronic document is also selected. Information that identifies the first and second media types for printing the first and second page ranges of one or more pages of the electronic document are transmitted to a printing device. In response to receiving the information, the printing device generates a printed copy of the electronic document that includes the first and second page ranges; the first page range being printed using the first media type and the second page range being printed using the second media type.

11 Claims, 12 Drawing Sheets

600

700

800

TABLE 900

| # | PAGE-RANGE | SINGLE/ DUPLEX | PAPER SOURCE | MEDIA TYPE | ETC. |
|---|---|---|---|---|---|
| 1 | 1-1 | S | TRAY 2 | 75 g/m$^2$ (WHITE) | |
| 2 | 2-4 | D | MANUAL FEEDER | RECYCLE (GRAY) | |
| 3 | 5-7 | S | TRAY 3 | GREEN | |
| 4 | 8-8 | S | TRAY 2 | 75 g/m$^2$ (WHITE) | |

FIG. 9A

TABLE 950

| | # | PAGE-RANGE | SINGLE/ DUPLEX | PAPER SOURCE | MEDIA TYPE | ETC. |
|---|---|---|---|---|---|---|
| 902 → | 1 | 1-2 | D | MANUAL FEEDER | GREEN COLORED | |
| | 2 | 3-6 | S | TRAY 1 | THIN | |
| | 3 | 7-20 | S | TRAY 3 | RECYCLE | |
| | 4 | 21-22 | D | TRAY 2 | LETTERHEAD | |
| | 5 | 23-200 | S | LCT | THICK | |

FIG. 9B

MULTIPLE PAGE-RANGE PRINTER SETTINGS

COPYRIGHT AUTHORIZATION

A portion of the disclosure of this patent document contains material which is subject to copyright protection. The copyright owner has no objection to the facsimile reproduction by any one of the patent disclosures, as it appears in the U.S. Patent & Trademark Office patent files or records, but otherwise reserves all copyright rights whatsoever.

FIELD OF THE INVENTION

The present invention generally relates to the printing of electronic documents. The invention relates more specifically to a mechanism for printing multiple page-ranges within an electronic documents.

BACKGROUND OF THE INVENTION

Computers and output devices such as printers are extensively used in word processing and other document management tasks. In general, each computer is typically connected to one or more printing devices. The connection may be over a dedicated line that is established directly between the computer and the printing device or instead, through a shared network, such as a company's internal network or LAN that allows the printing device to be shared by multiple computers connected to the network. In general, to allow a computer to communicate with a particular printing device, a print driver that is associated with the specific printing device is installed on the client computer. Each print driver includes a set of commands that allow applications executing on the client to communicate with the corresponding printing device.

Conventionally, when a user selects a print option to print an electronic document, the user is presented with an interface window that allows the user to select or enter certain parameters for printing the electronic document. For example, FIG. 1A illustrates a conventional print interface window 100 that is displayed to a user in response to the user selecting a print option. As depicted, print interface window 100 includes, among other things, a page range selector 104 and a properties button 102. The page range selector 104 allows a user to select a range of pages that are to be sent to a printing device for generating a printed copy (hard-copy) of the selected pages. For example, using page entry box 106, the user may select pages 1, 3 and 5–12 for printing by the printing device that is identified in printer name entry box 108.

Additionally, in response to selecting the properties button 102, the user is presented with a properties window 150 as depicted in FIG. 1B. By interfacing with the properties window 150, the user may select the paper size format (for example, Letter 8½×11 in., Legal 8½×14 in., A4 210×297 mm), and the paper source (i.e., Paper Tray) that is to be used for printing the electronic document.

For example, using paper size drop-down window 158, the user can choose from a set of preselected paper formats. Once selected, the paper format is then used to print all pages within the range of pages selected in page entry box 106.

Also, by selecting "Tray2" in entry box 156, the user may cause the selected pages to be printed using whatever media type that happens to be currently loaded in Tray 2 of the printing device. In addition, by selecting the "Different Paper for 1st Page" option 152, the user may select the paper source that is to be used for printing the first page of the selected range of pages. For example, by selecting "Tray1" in entry box 154, the user may cause the first page of the selected range of pages to be printed using the media type that is currently loaded in Tray 1 of the printing device.

However, a significant drawback with using a conventional printing mechanism as depicted in FIGS. 1A and 1B is that the user can only select a single paper size format, thus requiring that all pages within the selected page range be printed using the same paper size format.

In addition, a further drawback with using a conventional printing mechanism is that the user is limited to only two paper sources for printing the pages of an electronic document, and in the case of pages 2-n of the selected page range ("base pages"), the user is limited to only a single paper source. Furthermore, the user can only select the specific tray that is to be used as a paper source for printing the document. Thus, the user is not provided with any information as to the type of media that is associated with a specific tray selection (for example, 8½×11 paper, 8 2×14 paper, recycled paper, transparencies, color paper, etc.), let alone the actual type of media that is available for generating a hard copy of the electronic document.

In addition, because the conventional printing mechanism fails to provide the user with any information as to the media type that is currently loaded with a particular paper source, the user can mistakenly select a paper size format that is inconsistent with the media type that is currently loaded with a particular paper source.

Based on the foregoing, there is a clear need for a printing mechanism that allows a user to flexibly select the media types that are used to print a hard copy of a particular range of pages within an electronic document.

There is also a need for a printing mechanism that provides a user with dynamic information as to the media types that are currently available to the user for printing a hard copy of an electronic document.

There is also a need for a printing mechanism that allows a user to select multiple paper size formats for printing pages within a selected page range.

There is also a need for a printing mechanism that identifies to the user the set of one or more paper size formats that are compatable with the media types that are currently associated with the printing device.

Still further, there is a clear need for a printing mechanism that will allow a user to select multiple paper sources for printing the pages within a multiple base page range of an electronic document.

SUMMARY OF THE INVENTION

A method and system for printing an electronic document is disclosed. In one aspect, a first media type for printing a first page range of one or more pages of an electronic document is selected. A second media type for printing a second page range of one or more pages of the electronic document is also selected. Information that identifies the first and second media types for printing the first and second page ranges of one or more pages of the electronic document are transmitted to a printing device.

According to one feature, in response to receiving the information, the printing device generates a printed copy of the electronic document that includes the first and second page ranges; the first page range being printed using the first media type and the second page range being printed using the second media type.

According to another aspect, a method and system for printing an electronic document is disclosed whereby a request is received for delivery of a set of print attributes that are available for printing said electronic document on said printing device. User interface data, that identifies the set of print attributes that are available for printing said electronic document on said printing device, is generated. The user interface data is transmitted to a client device for displaying the set of print attributes that are available for printing said electronic document on said printing device.

In other aspects, the invention encompasses a computer apparatus, a computer-readable medium, and a carrier wave configured to carry out the foregoing steps.

BRIEF DESCRIPTION OF THE DRAWINGS

The present invention is illustrated by way of example, and not by way of limitation, in the figures of the accompanying drawings and in which like reference numerals refer to similar elements and in which:

FIG. 9A is a table that illustates an example of the type of information that may be collected by the printing mechanism based on FIGS. 3–8;

FIG. 9B is another table that illustrates a further example of the type of information that may be collected by the printing mechanism based on a different set of selections than those described in FIGS. 3–8;

DETAILED DESCRIPTION OF THE PREFERRED EMBODIMENT

A method and system for printing an electronic document is described. In the following description, for the purposes of explanation, numerous specific details are set forth in order to provide a thorough understanding of the present invention. It will be apparent, however, to one skilled in the art that the invention may be practiced without these specific details. In other instances, well-known structures and devices are shown in block diagram form in order to avoid unnecessarily obscuring the invention.

Operational Context

A printing mechanism is provided for generating a hard copy of pages that are contained in an electronic document. In one embodiment, when a user selects a print option to print an electronic document, the user is presented with an interface window that allows the user to select multiple page-ranges within the electronic document. The user may also select from a variety of print options that may include specific print characteristics, for example simplex/duplex modes or the ink color, that are to applied to one or more of the multiple page-ranges; specific media types that are to be used to print the pages of one or more of the multiple page-ranges; or specific paper sources that are to be used to print the pages of one or more of the multiple page-ranges.

In one embodiment, in response to a user selecting a print option at a client, a print message is sent from the client to a printing device to request information about the specific media types that are currently available for printing pages of the electronic document. In response to receiving the print message, the printing device returns current media type information to the client that identifies the media types that are currently available at the printing device. Based on the current media type information, an interface window is generated and presented to the user at the client. The user may then select specific media types that are to be used to generate a hard copy of selected page-ranges within the electronic document.

In certain embodiments, upon receiving a print message, the printing device generates a print window interface based on the specific characteristics of the selected printing device. The selected printing device then forwards the print window interface to the client computer for display to the user.

Figure 2:
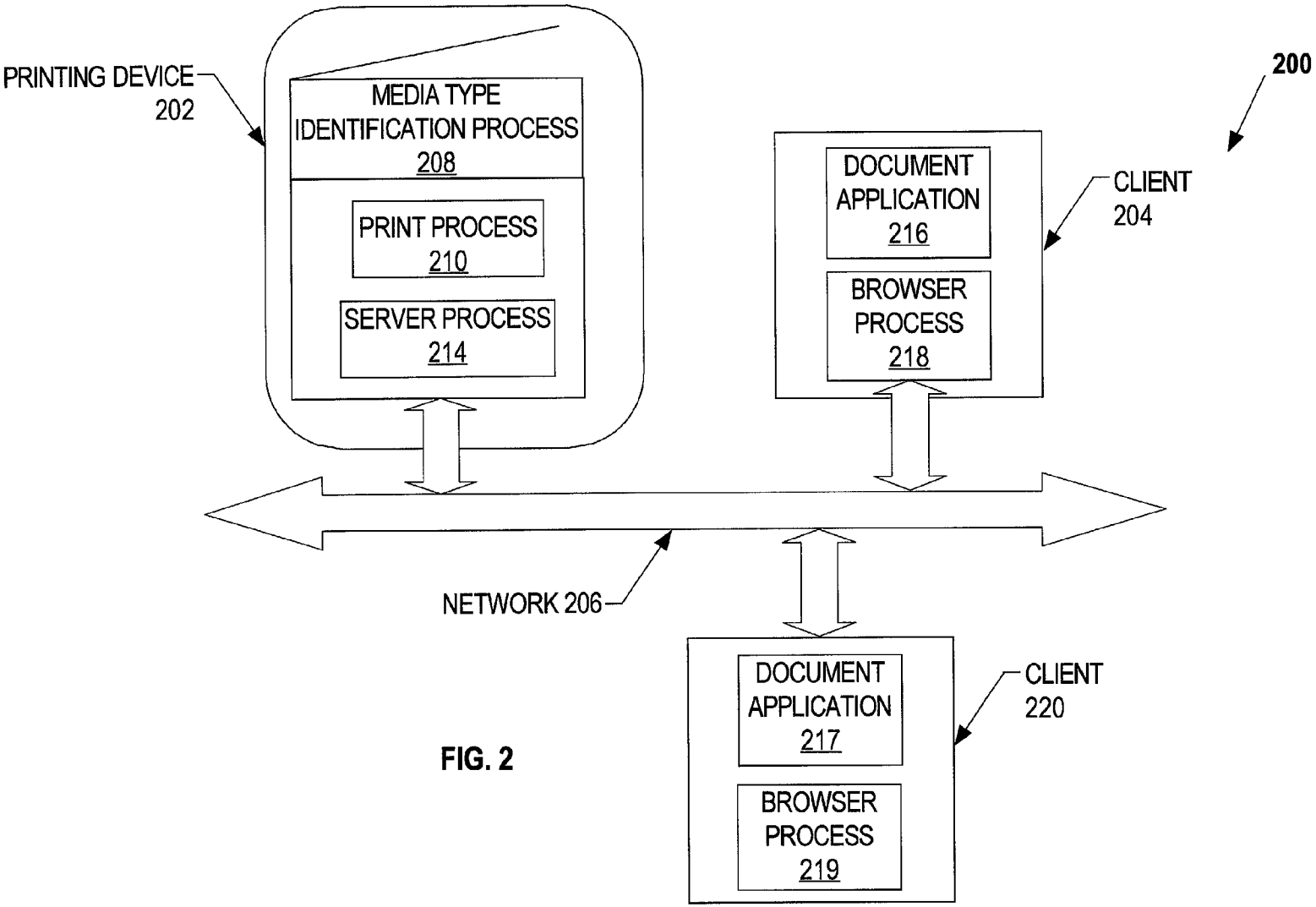
FIG. 2 illustrates a block diagram of a document printing system in which the invention may be utilized.

FIG. 2 illustrates a block diagram of a document printing system 200 in which the invention may be utilized. The system 200 generally includes a printing device 202, one or more computing devices (Clients 204,220), and a network 206.

The computing devices 204 and 220 each comprise a workstation, personal computer, lap-top computer, hand-held device, often referred to as a "Highly Constrained" device (e.g. cellular phones, Palm Pilots, PDAs, etc.) or other similar type of devices that can be configured to communicate with printing device 202. In this example, client 204 includes a document application 216 and a browser process 218. The document application 216 provides a mechanism for generating and viewing electronic documents. For example, document application 216 may represent any number of software applications which may include but is not limited to Microsoft Word®, WordPerfect®, Microsoft Excel®, Power Point, Lotus Notes, Adobe Acrobat, etc. Thus, computing devices 204 and 220 may contain or have access to, an assortment of different electronic document information that has been created in a variety of different file formats.

Browser process 118 represents a browser type application, such as Netscape Navigator®, Microsoft Internet Explorer®, or other similar type of WAP or HTML browser application that may be used to communicate with printing device 202 in a client-server relationship. In one embodiment, browser process 218 provides a display interface that allows a user to select from a variety of different print options for printing pages of an electronic document on printing device 202. In one embodiment, browser process 118 provides a user interface for selecting multiple page-ranges of an electronic document and the specific media types that are to be used by printing device 202 to print the pages within each page-range.

Network 206 provides a communication link between printing device 202 and the computing devices 204 and 220. Network 206 may represent any number of communication mechanisms which may include but is not limited to the global packet-switched network known as the Internet, a private Intranet for a particular company, a dedicated serial or parallel link, a wireless communication link, a telephone or cable line, or any combination thereof. The network 206 may form part of a LAN or WAN and may use a variety of different communication protocols.

The printing device 202 is configured to communicate with clients 204 and 220 over network 206 and to collect or generate print characteristic data based on the specific characteristics of the printing device 202. In this example, printing device 202 is a multifunctional printer or multifunctional peripheral (MFP) that includes, among other things, a media type ID process 208, a print process 210 and a server process 214.

Media type ID process 208 provides a mechanism for entering the type of media that is currently loaded in each tray of printing device 202. In one embodiment, Media type ID process 208 generates a set of media characteristic data that contains specific information as to the media type that is available for printing documents on printing device 202. In certain embodiments, Media type ID process 208 is coupled to an operational panel that provides an interface which allows a user to input information about specific characteristics of printing device 202. For example, printing device 202 may include an operational panel that can be used to enter information about the media types that are loaded into the different trays of printing device 202.

Print process 210 provides a mechanism for printing selected pages of electronic documents that are received from clients 104 and 120 over network 106. In one embodiment, print process 110 is configured to receive information identifying a particular media type that is to be used to print a range of pages within an electronic document. Based on the identified media type, print process 110 selects the appropriate paper source and uses the media within the paper source to generate a hard-copy printout of the pages within the range of pages.

Server process 114 is configured to receive print requests from clients 104 and 120. In certain embodiments, in response to receiving a print request, server process 114 generates interface data for displaying a multiple page-range interface window on the requesting client. In one embodiment, the interface data includes information about the specific characteristics of the printing device, for example the currently available media types which are generally not available in a conventional printing interface. By interacting with the multiple page-range interface window the user may select specific media types, specific paper sources and/or specific print characteristics that are to be applied to multiple page-ranges within an electronic document.

In certain embodiments, server process 114 is configured as a Web server that provides a communication mechanism for communicating with clients via network 206. In one embodiment, the Web server includes a Hypertext Transfer Protocol (HTTP) daemon that can respond to requests from clients 104 and 120 and establish an HTTP connection between the printing device 202 and the requesting client. HTTP is merely an example of a communications protocol that can be used in an embodiment. Other protocol that facilitates exchange of information among a client and server can be used.

Multiple Page-Range Printing Interface

A multiple page-range printing interface is provided that allows a user to select multiple page-ranges within a document and to choose individual print attributes for printing the pages within each page range. In one embodiment, information defining the multiple page-range printing interface is provided as an HTML or XML document to either client 204 or 220 from printing device 202. In certain embodiments, the multiple page-range printing interface includes one or more print attribute options that are based on specific characteristics of the selected printing device. For example, the multiple page-range printing interface may include a list of the different media types that are currently available to the user based on the particular characteristics of the printing device that has been selected. In one embodiment, a mapping is maintained between the available media types and the one or more paper sources that contain each of the available media types.

In certain embodiments, in response to a change in the characteristics of the selected printing device, the multiple page-range printing interface is dynamically updated to reflect the current characteristics of the selected printing device. For example, in response to a new media type being loaded into "tray 1" of the selected printing device, the multiple page-range printing interface may be automatically updated to reflect a new list of media types that are currently available to the user based on the current characteristics of the selected printing device. Additionally, if the user selects a different printing device, the multiple page-range printing interface automatically updates to display the set of print attribute options that are currently available based on the newly selected printing device.

Figure 3:
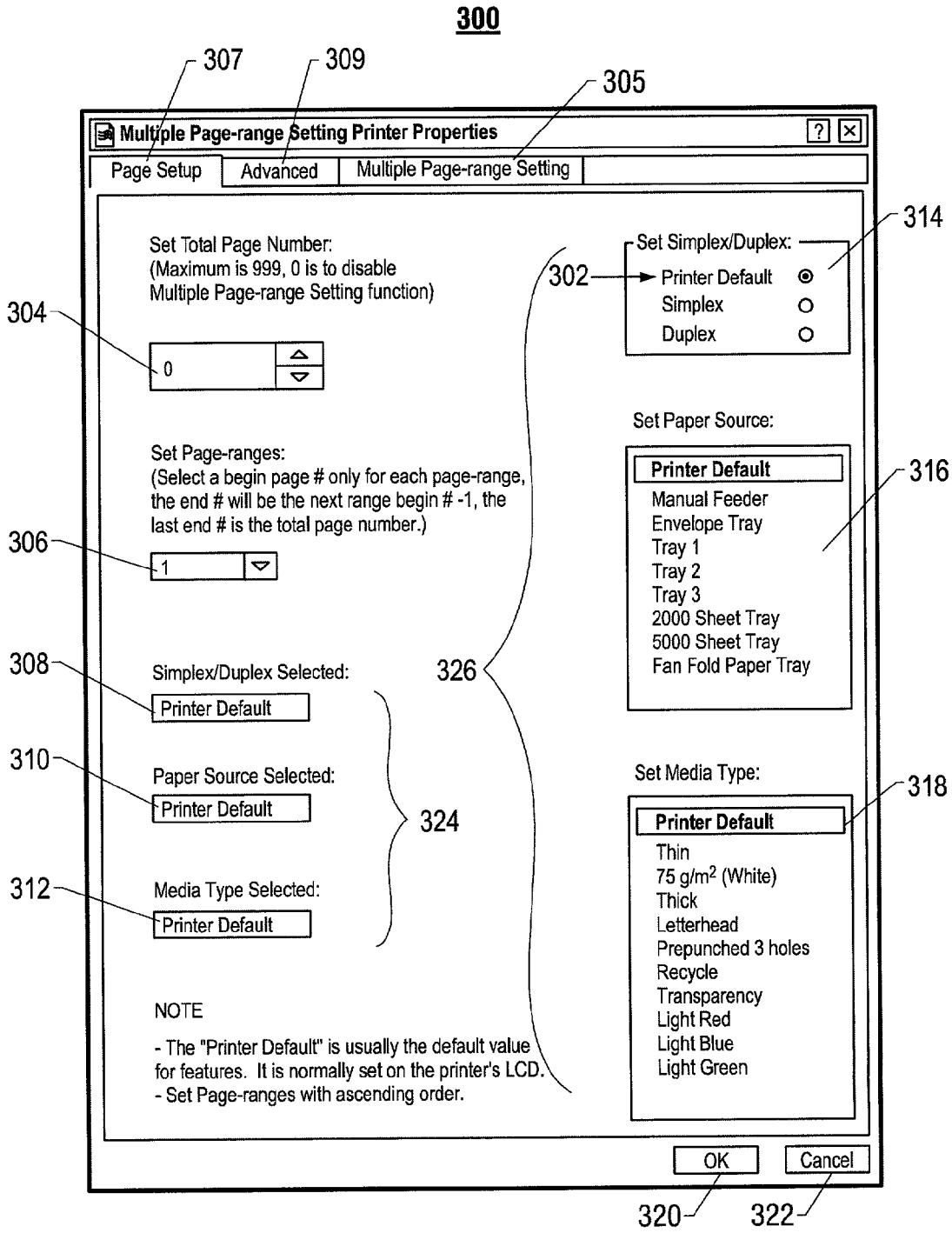
FIG. 3 is an example of a multiple page-range printing interface window that may be displayed to a user.

FIG. 3 illustrates an example of a multiple page-range printing interface 300 that may be displayed by browser process 218 on client 204. In this example, interface 300 includes a total page entry box 304, a begin range entry box 306, a set of selected print attribute boxes 324, and a set of print attributes option boxes 326. In one embodiment, printer characteristic information that is not generally available to the client, such as the media type that is currently loaded in the printing device, is dynamically provided by printing device 202 for display within multiple page-range printing interface 300.

Figure 1A:
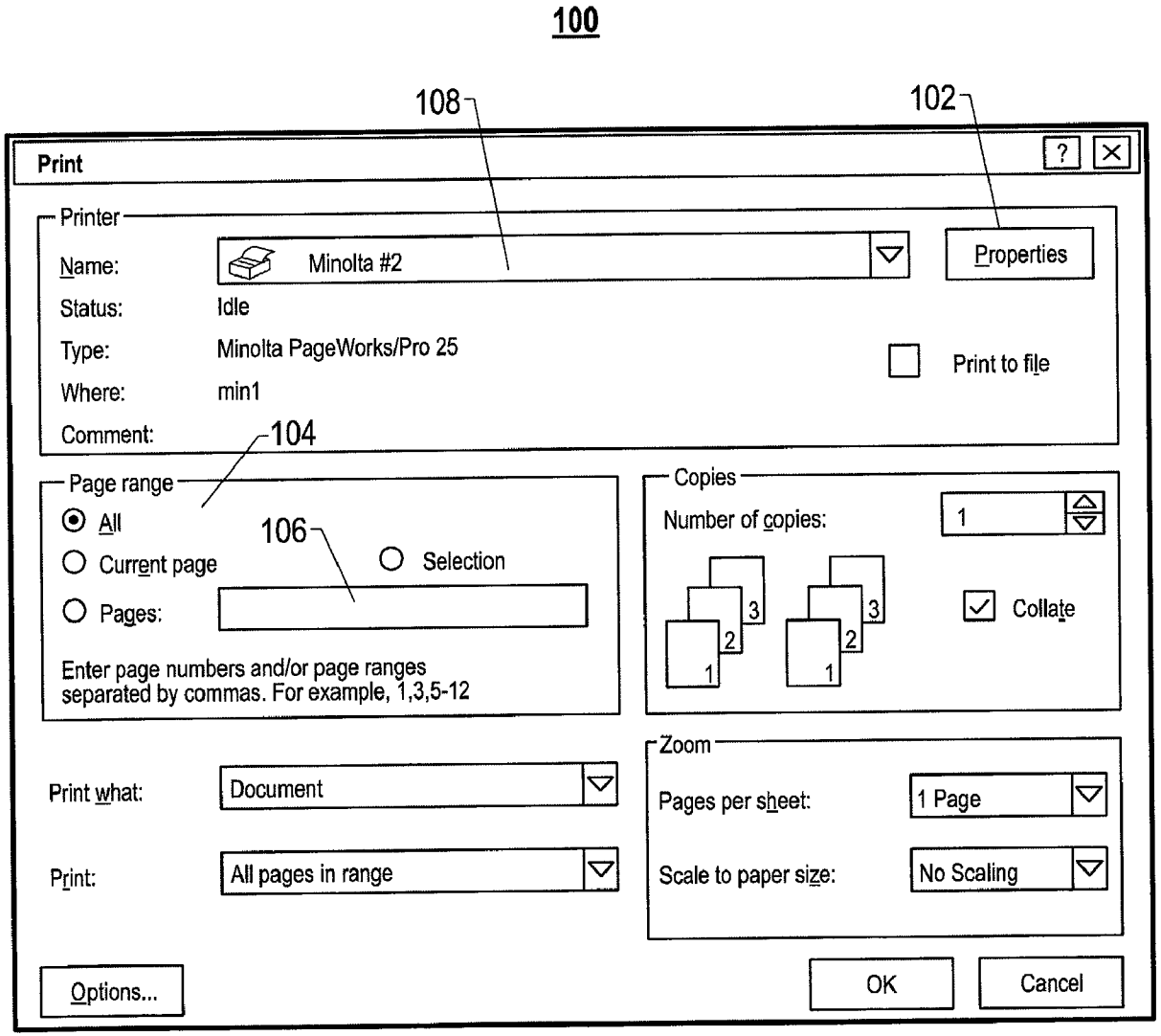
FIG. 1A is a conventional print interface window that is displayed to a user in response to the user selecting a print option.
Figure 1B:
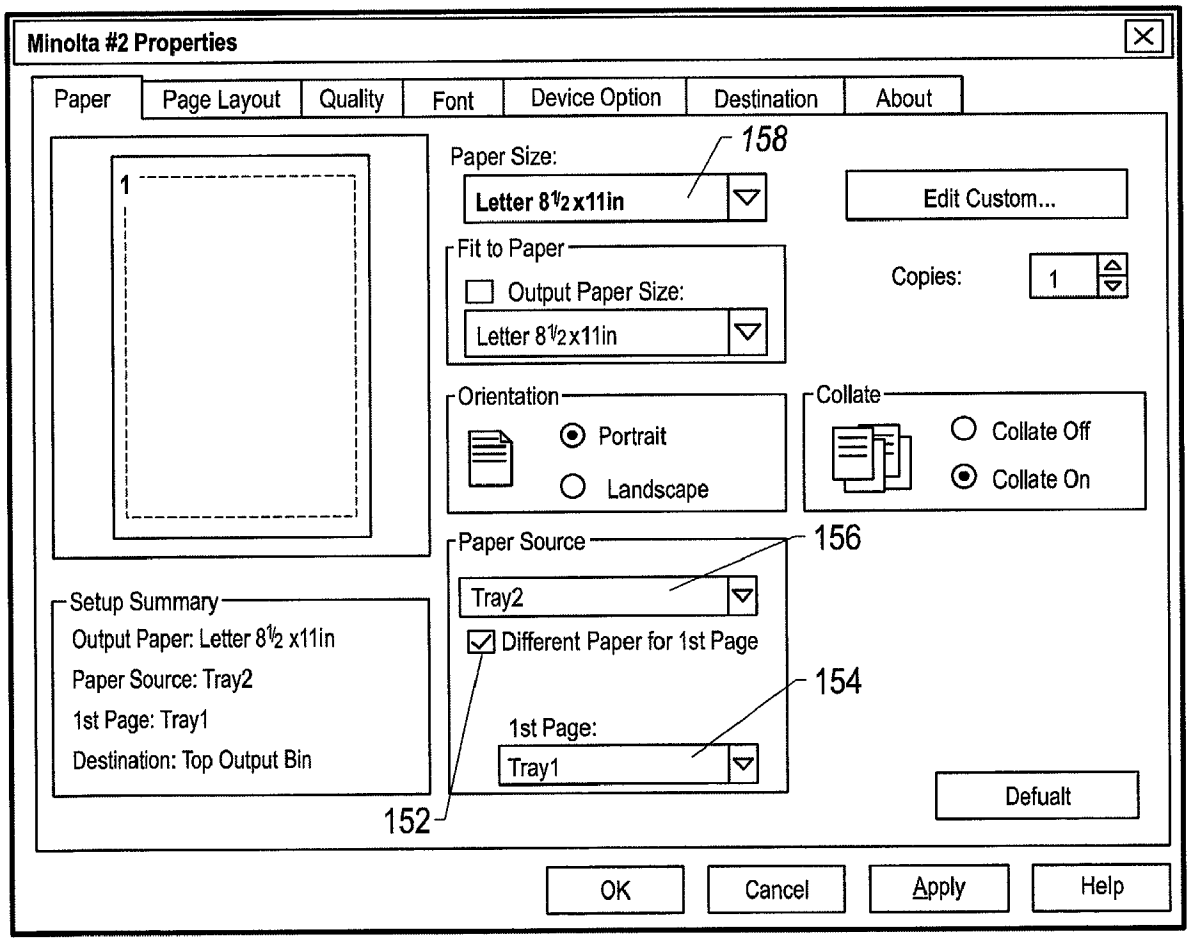
FIG. 1B is another conventional print interface window that is optionally displayed to a user.

Total page entry box 304 allows the user to enter the total number of pages that are to be printed within the electronic document. For example, if the user wants to print a hard copy of the first one-hundred pages of a document, the user enters the value "100" in total page entry box 304. In one embodiment, by entering a value of zero ("0"), the multiple page-range mechanism is disabled, thus causing the settings under the "Multiple Page-range Setting" tab 305 to be ignored by the system. For example, in certain embodiments, a "Page Setup" tab 307 and an "Advanced" tab 309 provide a mechanism whereby the user may select from a set of conventional print options (for example, conventional options previously depicted in FIGS. 1A and 1B), for printing an electronic document. In certain embodiments, by entering a value of zero ("0") in total page entry box 304, the set of convential print options are used for printing pages of the electronic document.

Alternatively, by entering a non-zero value in total page entry box 304, the user is presented with an interface (for example multiple page-range printing interface 400 in FIG. 4) for entering one or more page-ranges and the set of printing attributes that are to be applied to each range of pages.

Begin range entry box 306 enables the user to select a specific range of pages for which the selected printing attributes will apply. How a user may select multiple page-range settings using begin range entry box 306 is described in detail below using the examples in FIGS. 4–11.

In this example, the set of print attributes option boxes 326 include a set simplex/duplex option box 314, a set paper source option box 316 and a Set media type option box 318.

The set simplex/duplex option box 314 enables a user to print the selected range of pages using either simplex or duplex mode. Simplex/duplex selected box 308 indicates the current selection that the user has made for the selected page range. In one embodiment, by selecting printer default option 302 in set simplex/duplex option box 314, the user can choose to have the selected range of pages to be printed using the default setting of the selected printing device.

Set paper source option box 316 enables a user to select a specific paper source that is to be used in printing the selected range of pages. Paper source selected box 310 indicates the paper source that the user has selected for printing the particular range of pages.

Set media type option box 318 enables a user to select a specific media type that is to be used in printing the selected range of pages. In one embodiment, set media type option box 318 automatically updates to reflect the media types that are currently loaded in the selected printing device. Media type selected box 312 indicates the media type that the user has selected for printing the particular range of pages.

The OK button 320 allows the user to initiate the printing of the one or more selected page-ranges based on the print attributes that have been selected by user. The Cancel button 322 allows the user to cancel the print request, thus causing the selected page-ranges not to be printed.

Selecting Page-Ranges and the Print Attributes that Apply

Figure 4:
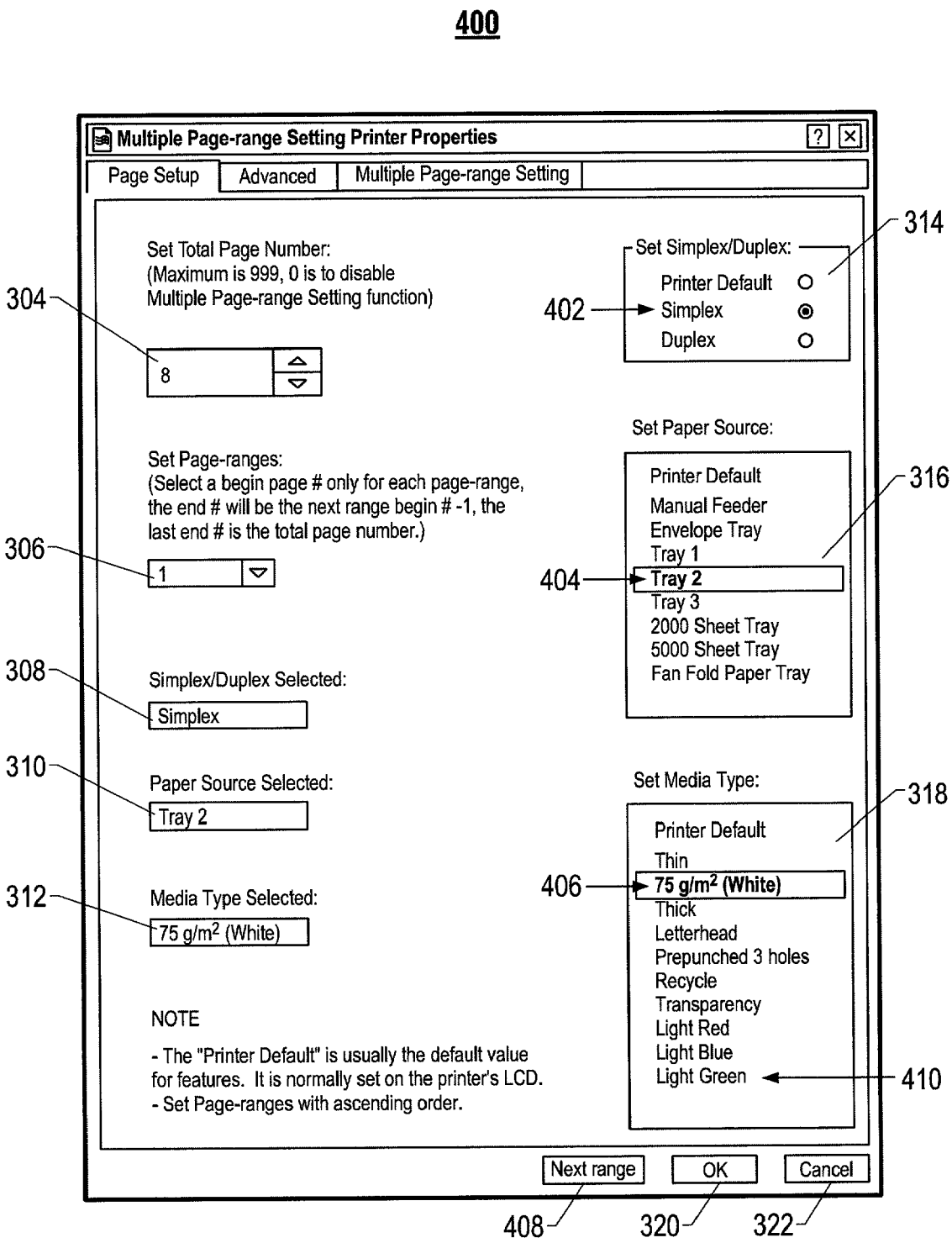
FIG. 4 is another example of a multiple page-range printing interface window that may be displayed to a user.

As previously indicated, by entering a non-zero value in total page entry box 304, the user is presented with an interface for entering one or more page-ranges and the printing attributes that are to be applied to each of the page-ranges. FIG. 4 illustrates an example multiple page-range printing interface 400 that may be displayed by browser process 218 on client 204 in response to a user entering a non-zero value in total page entry box 304. In this example, a user has entered a value of eight ("8") in total page entry box 304, thus indicating that a total of eight ("8") pages are to be printed. As further depicted, the user has selected a value of one ("1") in begin range entry box 306 to indicate that the current page-range is to start with page one ("1") of the electronic document. In one embodiment, the printing mechanism determines that the page-range associated with multiple page-range printing interface 400 currently consists of pages 1–8 (e.g., the value of begin range entry box 306 to the value of total page entry box 304).

Simplex/duplex selected box 308 indicates that the user has selected simplex option 402 in set simplex/duplex option box 314 for the selected page range; paper source selected box 310 indicates that the user has selected "tray 2" option 404 in set paper source option box 316 as the paper source for the selected page range; and media type selected box 312 indicates that the user has selected "75 g/m$^2$ (White)" option 406 in set media type option box 318 as the media type for the selected page range.

In one embodiment, in response to selecting a specific media type in set media type option box 318, the paper source selected box 310 is automatically updated to reflect the paper source that contains the selected media type in the printing device. For example, in response to the user selecting light green option 410, if "tray 1" of the printing device represents the paper source that is currently loaded with light green paper, the paper source selected box 310 is automatically updated to indicate a selected paper source of "tray 1". In certain embodiments, the multiple page-range printing interface may only provide for selecting the specific media type (set media type option box 318 and media type selected box 312) and thus not include a selection option for selecting the specific paper source (i.e., set paper source option box 316 and paper source selected box 310).

After entering the specific attributes that are to be used for the current page-range, the user may select by pressing or clicking the next range button 408 to enter additional page-ranges and the printing attributes that are to be applied to each of the additional page-ranges.

Figure 5:
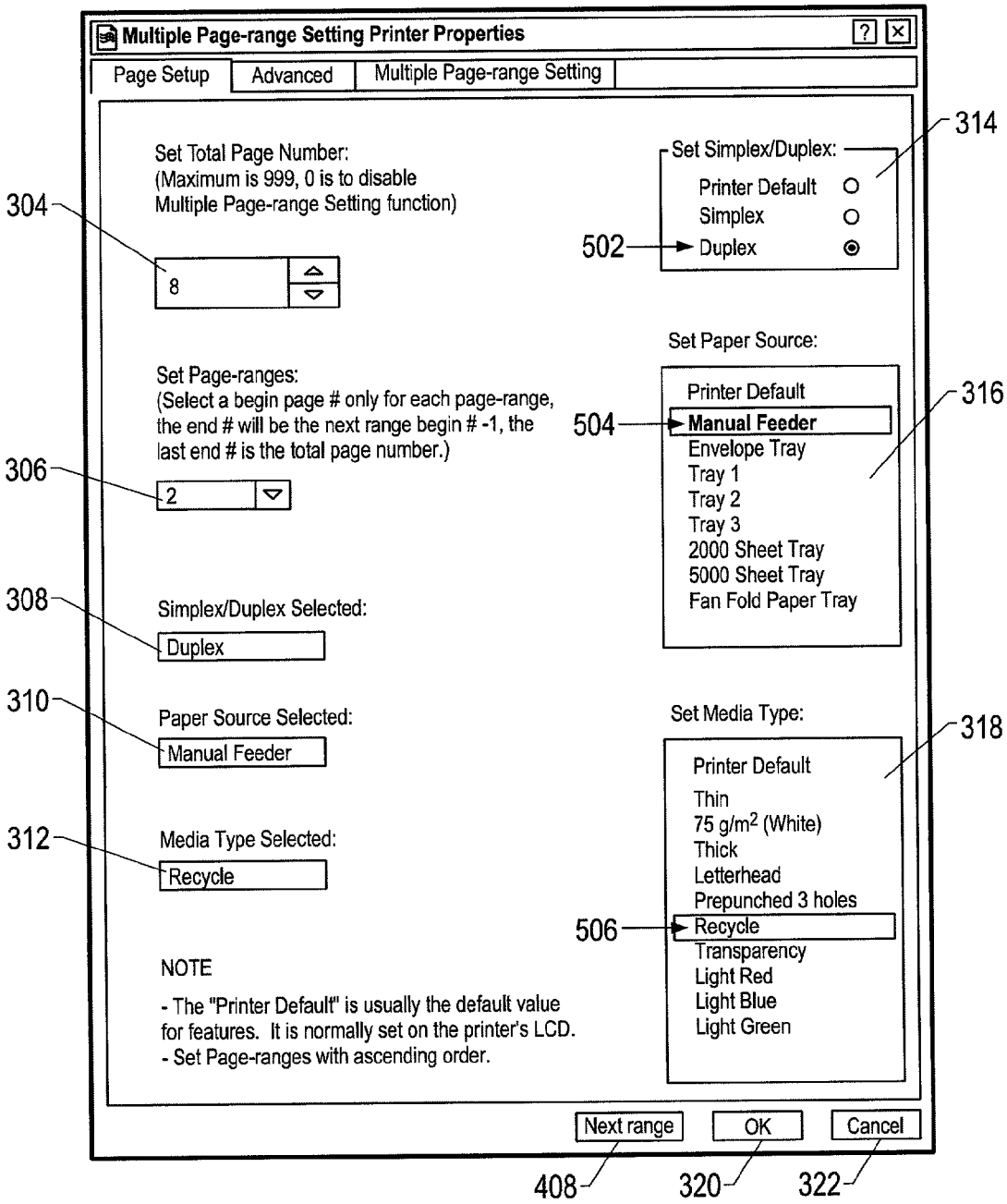
FIG. 5 is another example of a multiple page-range printing interface window that may be displayed to a user.

For example, FIG. 5 illustrates an example multiple page-range printing interface 500 that may be displayed by browser process 218 on client 204 in response to user selecting the next range button 408. In this example, the user has selected a value of two ("2") in begin range entry box 306 to indicate that the current page-range is to start with page two ("2") of the electronic document. In one embodiment, the printing mechanism uses the new value in begin range entry box 306 in determining the last page of the previous page-ranges that have been entered. For example, by entering the value "2" in begin range entry box 306 of multiple page-range printing interface 500, the printing mechanism determines that the page-range associated with multiple page-range printing interface 400 consists of pages 1—1. Additionally, the printing mechanism determines that the page-range associated with multiple page-range printing interface 500 currently consists of pages 2–8.

Further to this example, the simplex/duplex selected box 308 indicates that the user has selected duplex option 502 in set simplex/duplex option box 314 for the selected page range; the paper source selected box 310 indicates that the user has selected "Manual Feeder" option 504 in set paper source option box 316 as the paper source for the selected page range; and the media type selected box 312 indicates that the user has selected "Recycle" option 506 in set media type option box 318 as the media type for the selected page range.

Again, after entering the specific attributes that are to be used for the current page-range in multiple page-range printing interface 500, the user may select the next range button 408 to enter additional page-ranges and the printing attributes that are to be applied to each of the additional page-ranges.

Figure 6:
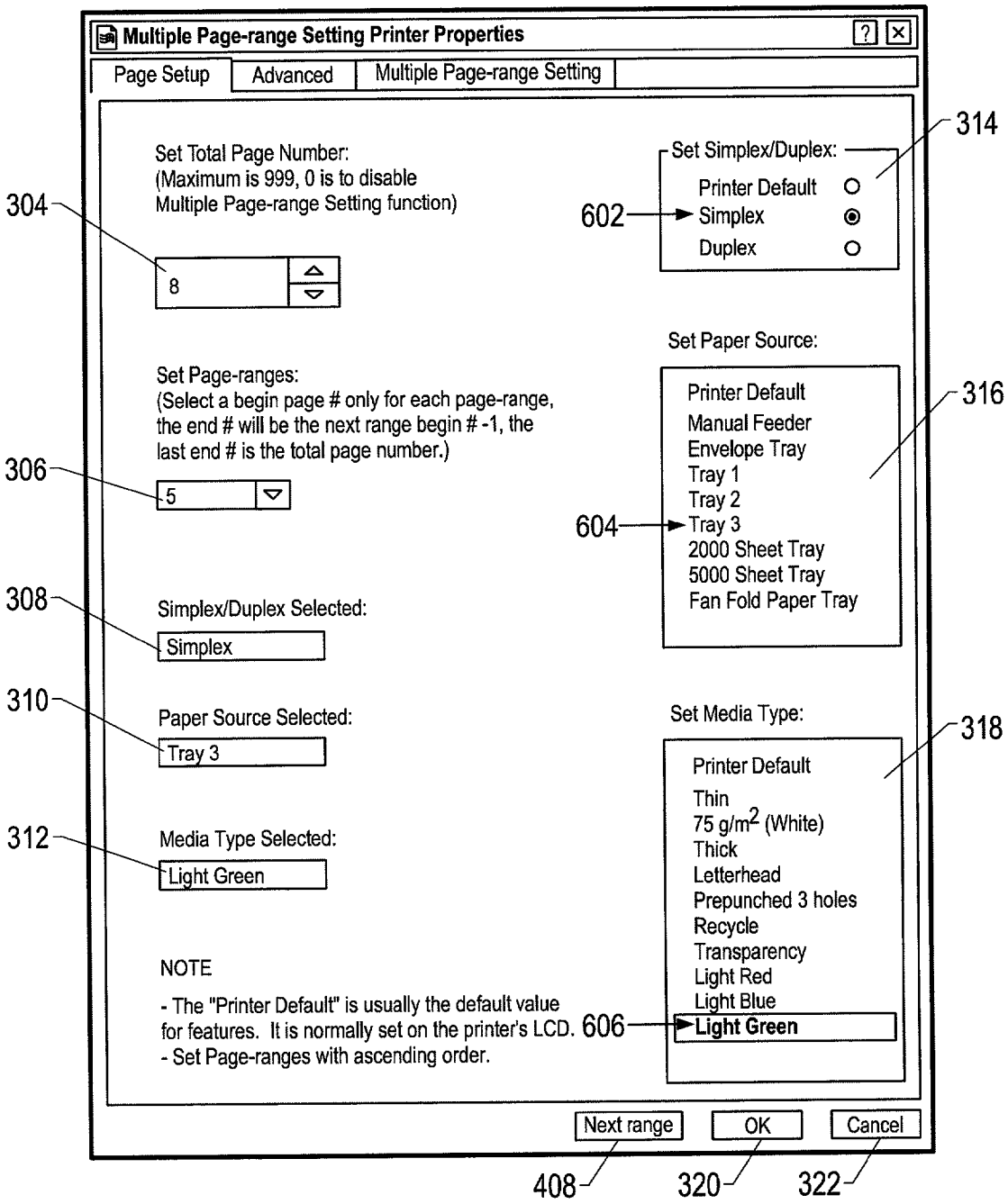
FIG. 6 is another example of a multiple page-range printing interface window that may be displayed to a user.

FIG. 6 illustrates another example of a multiple page-range printing interface 600 that may be displayed by browser process 218 on client 204 in response to user selecting the next range button 408 in multiple page-range printing interface 500. In this example, the user has selected a value of five ("5") in begin range entry box 306 to indicate that the current page-range is to start with page five ("5") of the electronic document. In one embodiment, the printing mechanism uses the new value in begin range entry box 306 in determining the last page of the previous page-ranges that have been entered. For example, by entering the value "5" in begin range entry box 306 of multiple page-range printing interface 600, the printing mechanism determines that the page-range associated with multiple page-range printing interface 500 consists of pages 2–4. Additionally, the printing mechanism determines that the page-range associated with multiple page-range printing interface 600 currently consists of pages 5–8.

Further illustrated in this example, the simplex/duplex selected box 308 indicates that the user has selected simplex option 602 in set simplex/duplex option box 314 for the selected page range; the paper source selected box 310 indicates that the user has selected "Tray 3" option 604 in set paper source option box 316 as the paper source for the selected page range; and the media type selected box 312 indicates that the user has selected "Light Green" option 606 in set media type option box 318 as the media type for the selected page range.

Once again, after entering the specific attributes that are to be used for the current page-range in multiple page-range printing interface 600, the user may select the next range button 408 to enter additional page-ranges and the printing attributes that are to be applied to each of the additional page-ranges.

Figure 7:
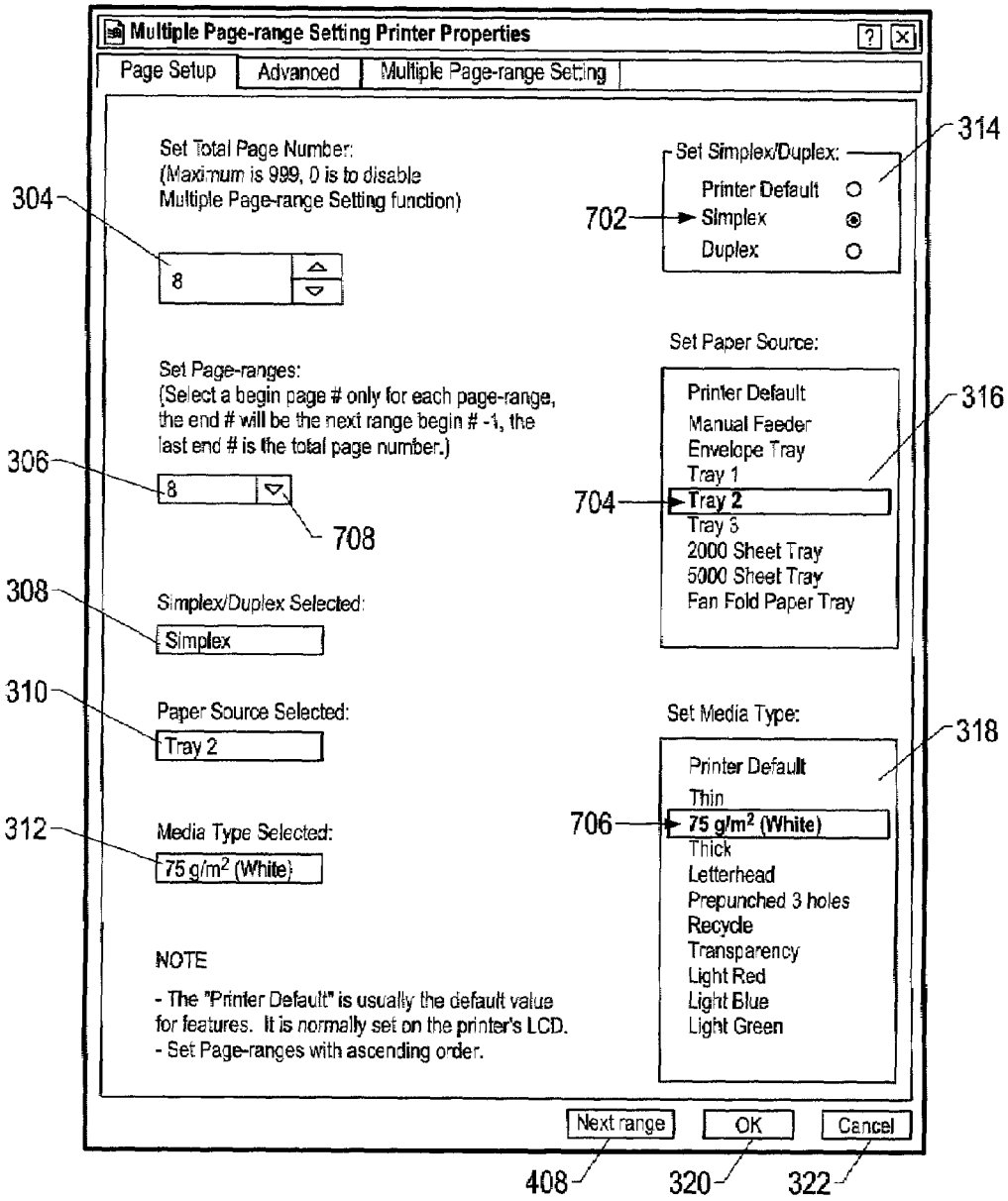
FIG. 7 is another example of a multiple page-range printing interface window that may be displayed to a user.

FIG. 7 illustrates another example of a multiple page-range printing interface 700 that may be displayed by browser process 218 on client 204 in response to user selecting the next range button 408 in multiple page-range printing interface 600. In this example, the user has selected a value of eight ("8") in begin range entry box 306 to indicate that the current page-range is to start with page eight ("8") of the electronic document. In one embodiment, the printing mechanism uses the new value in begin range entry box 306 in determining the last page of the previous page-ranges that have been entered. For example, by entering the value "8" in begin range entry box 306 of multiple page-range printing interface 700, the printing mechanism determines that the page-range associated with multiple page-range printing interface 600 consists of pages 5–7. Additionally, the printing mechanism determines that the page-range associated with multiple page-range printing interface 600 currently consists of pages 8—8.

Further illustrated in this example, the simplex/duplex selected box 308 indicates that the user has selected simplex option 702 in set simplex/duplex option box 314 for the selected page range; the paper source selected box 310 indicates that the user has selected "Tray 2" option 704 in set paper source option box 316 as the paper source for the selected page range; and the media type selected box 312 indicates that the user has selected "75 g/m$^2$ (White)" option 706 in set media type option box 318 as the media type for the selected page range.

Editing and Printing Selecting Page-Ranges

Figure 8:
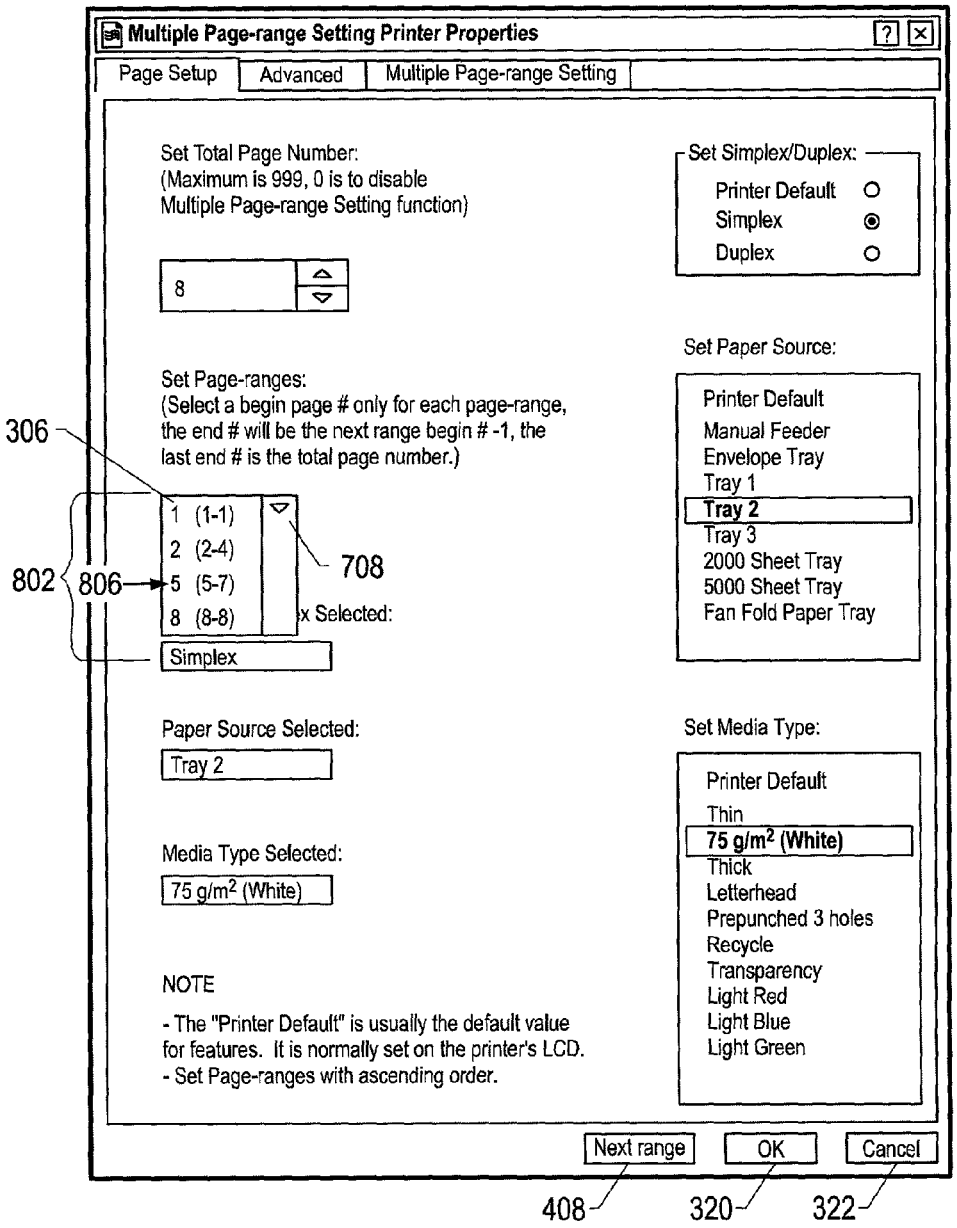
FIG. 8 is another example of a multiple page-range printing interface window that may be displayed to a user.

As illustrated in FIG. 7 and FIG. 8, in certain embodiments, begin range entry box 306 includes a radial option 708 that allows the user to view and edit the current page-ranges in addition to the print attributes that are currently associated with each of the page-ranges. For example, FIG. 8 illustrates another example of a multiple page-range printing interface 800 in which a current set of page-range entries 802 is displayed in response to the user selecting radial option 708. As illustrated, the user has selected multiple page-ranges 802 within pages 1–8, each of which have been assigned specific print attributes (media types, paper source, etc.), as previously described in FIGS. 3–7.

In one embodiment, in response to a user selecting a page-range within the current set of page-range entries 802, a multiple page-range printing interface is displayed to the user that includes the current settings for the selected page-range. For example, in response to a user selecting page-range entry 806, multiple page-range printing interface 600 is displayed by browser process 218 on client 204. The user may then change or edit the previous selections, including the value in begin range entry box 306.

Once the user is satisfied with their selections, they may select the OK button 320 to have the selected page-range and associated print attribute information ("print data") sent to the printing device. Upon receiving the print data, the printing device generates a hard copy version based on the print data.

For example, FIG. 9A illustrates a table 900 that includes an example of the type of information that may be collected in FIGS. 3–8. As a further example, FIG. 9B illustrates a table 950 that includes another example of the type of information that may be collected by the printing mechanism based on a different set of selections than those described in FIGS. 3–8. In this example, the set of multiple page-ranges contains a page-range entry 902 that includes pages 1–2, in addition to the other page-range entries.

Appendix A illustrates an example of the type of print data that may be generated for a laser printer for an 8-page document with multiple page-range settings as defined in Table 900. In one embodiment, in response to selecting the OK button 320, the print data is sent from client 204 to printing device 202 to generate a hard copy of the range of pages based on the selections made in FIGS. 3–8. In another embodiment, the print data is generated at the printing device and in response to selecting the OK button 320 a message is sent from client 204 to printing device 202 requesting that a hard copy be generated based on the print data.

If the user decides that they do not want to print the selected page-ranges, the user may instead select the cancel button 322 to cancel the print request. Alternatively, if the user wants to select one or more additional page-ranges, the user may select the next range button 408 to view another multiple page-range printing interface for entering additional page-range selections and corresponding print attributes.

Processing Print Requests

Figure 10:
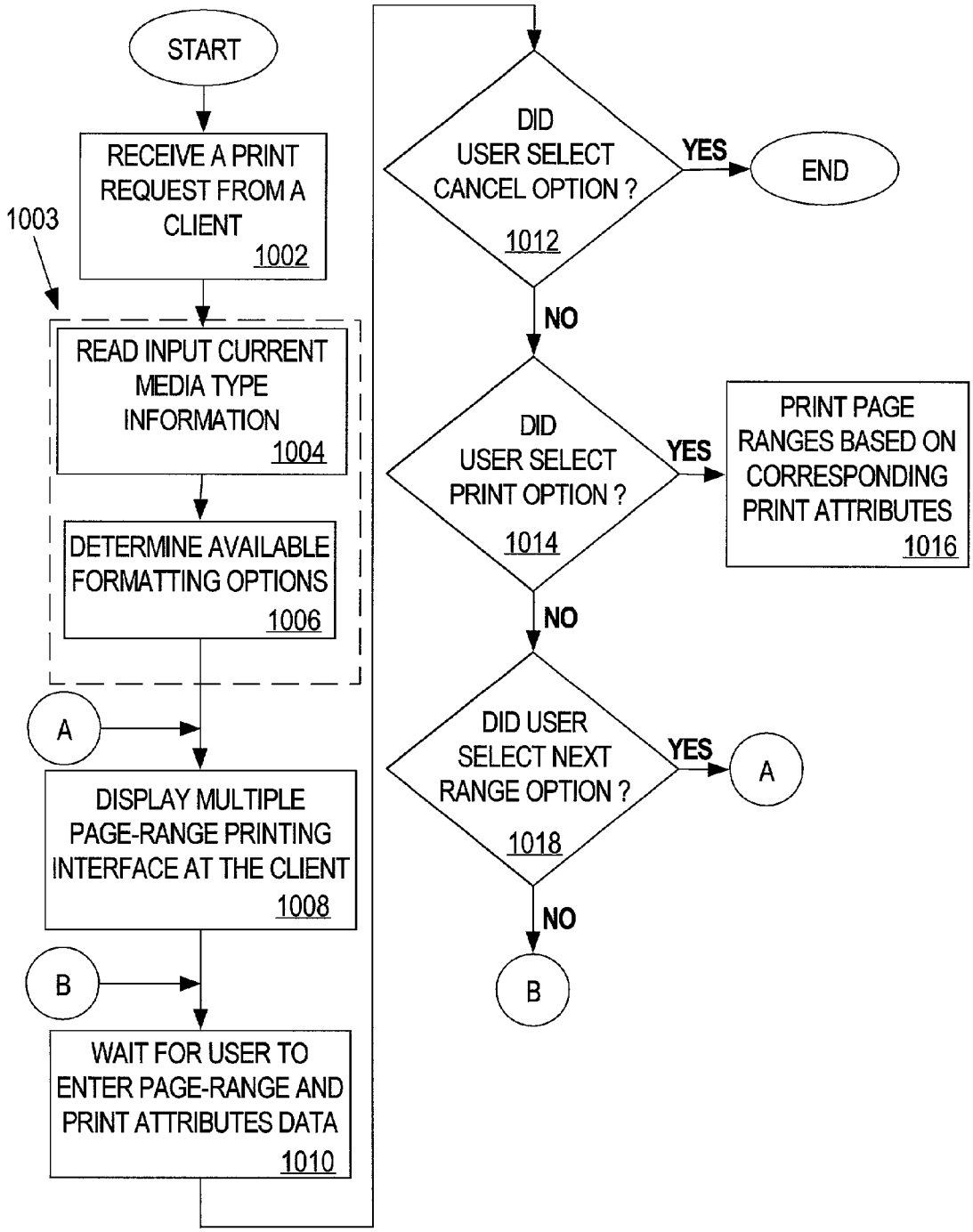
FIG. 10 is a flow diagram that illustrates an example of a sequence that can be used for processing multiple page-range print requests within an electronic document.

FIG. 10 is a flow diagram that illustrates an example of a sequence that can be used for processing multiple page-range print requests within an electronic document. The steps of FIG. 10 will be explained with reference to the components illustrated in FIGS. 2–8.

At block 1002, a print request is received from a client. For explanation purposes it shall be assumed that a print request is received at printing device 202 from client 204. For example, by interacting with client 204 a user may cause a print request to be sent from browser process 218 to server process 214 of printing device 102. In one embodiment, in response to selecting a print option associated with document application 216, browser process 218 is automatically executed to cause a print request to be sent to the currently selected printing device 202.

At block 1003, the specific printing characteristics of the selected printing device are obtained. These specific characteristics may include, among other things, available media type information and paper source (i.e., tray) that contains each of the media types (block 1004) and the set of formatting options (i.e., simplex/duplex, ink color, etc.) that are available to the client user (block 1006). In one embodiment, printing device 202 is configured to allow an operator to enter information through an operational panel to register the characteristic information that is specific to printing device 202 (for example, the media type information that is illustrated in set media type option box 318 in FIG. 3).

At block 1008, interface data is transmitted from the printing device to the client to cause a multiple page-range interface window to be displayed at the client. In one embodiment, the interface window includes a set of selectable options for specifying a specific page-range within the electronic document and for specifying the set of printing attributes that are to be applied to the pages within the specific page-range. For example, as depicted in FIG. 4, a multiple page-range printing interface 400 is displayed by browser process 218 on client 204 which allows a user to select a specific page-range and the printing attributes that are to be applied to the pages within the specific page-range.

At block 1010, the printing device waits for a response from the requesting client. If at block 1012 a response is received that indicates that the user selected the cancel button 322, then the printing sequence is ended.

Alternatively, if at block 1014 a response is received that indicates that the user selected the print button 320, then at block 1016, a hard copy version of the pages within each page-range is generated by the printing device based on the printing attributes that are associated with each page-range.

Lastly, if at block 1018 a response is received that indicates that the user selected the next range button 408, then the information associated with the current multiple page-range interface window is stored and control proceeds to block 1008 to display another multiple page-range interface window on client 204. Conversely, if a response is not received that meets the qualifications of either blocks 1012, 1014 or 1018, then control proceeds to block 1010 to wait for further user input.

Hardware Overview

Figure 11:
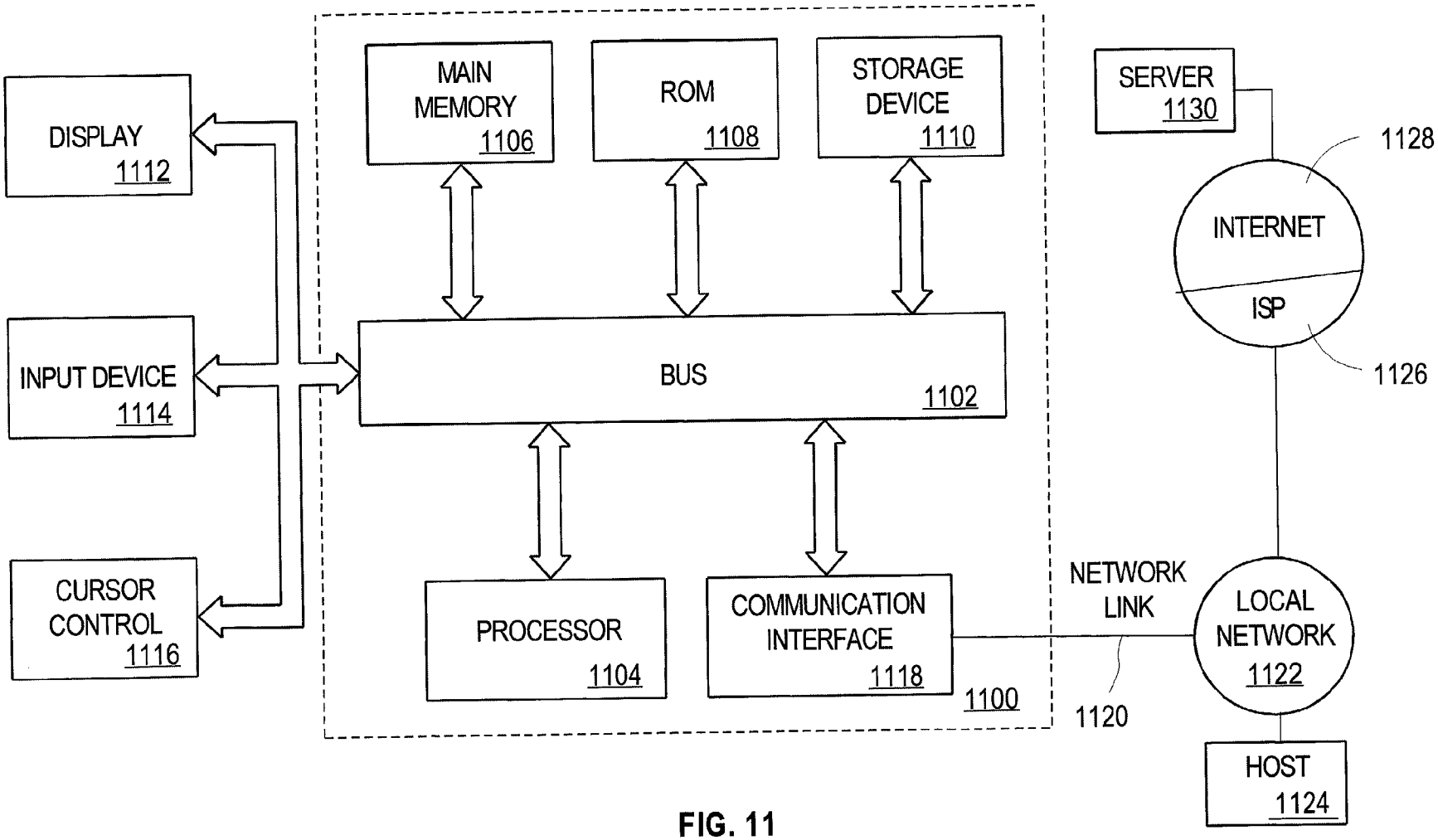
FIG. 11 illustrates an example of a computer system that may be used to provide the described printing mechanism.

FIG. 11 is a block diagram that illustrates a computer system 1100 upon which an embodiment of the invention may be implemented. Computer system 1100 includes a bus 1102 or other communication mechanism for communicating information, and a processor 1104 coupled with bus 1102 for processing information. Computer system 1100 also includes a main memory 1106, such as a random access memory (RAM) or other dynamic storage device, coupled to bus 1102 for storing information and instructions to be executed by processor 1104. Main memory 1106 also may be used for storing temporary variables or other intermediate information during execution of instructions to be executed by processor 1104. Computer system 1100 further includes a read only memory (ROM) 1108 or other static storage device coupled to bus 1102 for storing static information and instructions for processor 1104. A storage device 1110, such as a magnetic disk or optical disk, is provided and coupled to bus 1102 for storing information and instructions.

Computer system 1100 may be coupled via bus 1102 to a display 1112, such as a cathode ray tube (CRT), for displaying information to a computer user. An input device 1114, including alphanumeric and other keys, is coupled to bus 1102 for communicating information and command selections to processor 1104. Another type of user input device is cursor control 1116, such as a mouse, a trackball, or cursor direction keys for communicating direction information and command selections to processor 1104 and for controlling cursor movement on display 1112. This input device typically has two degrees of freedom in two axes, a first axis (e.g., x) and a second axis (e.g., y), that allows the device to specify positions in a plane.

The invention is related to the use of computer system 1100 for printing multiple page-ranges within an electronic document. According to one embodiment of the invention, the multiple page-range printing mechanism is provided by computer system 1100 in response to processor 1104 executing one or more sequences of one or more instructions contained in main memory 1106. Such instructions may be read into main memory 1106 from another computer-readable medium, such as storage device 1110. Execution of the sequences of instructions contained in main memory 1106 causes processor 1104 to perform the process steps described herein. One or more processors in a multi-processing arrangement may also be employed to execute the sequences of instructions contained in main memory 1106. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to processor 1104 for execution. Such a medium may take many forms, including but not limited to, non-volatile media, volatile media, and transmission media. Non-volatile media includes, for example, optical or magnetic disks, such as storage device 1110. Volatile media includes dynamic memory, such as main memory 1106. Transmission media includes coaxial cables, copper wire and fiber optics, including the wires that comprise bus 1102. Transmission media can also take the form of acoustic or light waves, such as those generated during radio wave and infrared data communications.

Common forms of computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor 1104 for execution. For example, the instructions may initially be carried on a magnetic disk of a remote computer. The remote computer can load the instructions into its dynamic memory and send the instructions over a telephone line using a modem. A modem local to computer system 1100 can receive the data on the telephone line and use an infrared transmitter to convert the data to an infrared signal. An infrared detector coupled to bus 1102 can receive the data carried in the infrared signal and place the data on bus 1102. Bus 1102 carries the data to main memory 1106, from which processor 1104 retrieves and executes the instructions. The instructions received by main memory 1106 may optionally be stored on storage device 1110 either before or after execution by processor 1104.

Computer system 1100 also includes a communication interface 1118 coupled to bus 1102. Communication interface 1118 provides a two-way data communication coupling to a network link 1120 that is connected to a local network 1122. For example, communication interface 1118 may be an integrated services digital network (ISDN) card or a modem to provide a data communication connection to a corresponding type of telephone line. As another example, communication interface 1118 may be a local area network (LAN) card to provide a data communication connection to a compatible LAN. Wireless links may also be implemented. In any such implementation, communication interface 1118 sends and receives electrical, electromagnetic or optical signals that carry digital data streams representing various types of information.

Network link 1120 typically provides data communication through one or more networks to other data devices. For example, network link 1120 may provide a connection through local network 1122 to a host computer 1124 or to data equipment operated by an Internet Service Provider (ISP) 1126. ISP 1126 in turn provides data communication services through the worldwide packet data communication network now commonly referred to as the "Internet" 1128. Local network 1122 and Internet 1128 both use electrical, electromagnetic or optical signals that carry digital data streams. The signals through the various networks and the signals on network link 1120 and through communication interface 1118, which carry the digital data to and from computer system 1100, are exemplary forms of carrier waves transporting the information.

Computer system 1100 can send messages and receive data, including program code, through the network(s), network link 1120 and communication interface 1118. In the Internet example, a server 1130 might transmit a requested code for an application program through Internet 1128, ISP 1126, local network 1122 and communication interface 1118. In accordance with the invention, one such downloaded application provides for printing multiple page-ranges as described herein.

The received code may be executed by processor 1104 as it is received, and/or stored in storage device 1110, or other non-volatile storage for later execution. In this manner, computer system 1100 may obtain application code in the form of a carrier wave.

Alternatives, Extensions

The document rinting mechanism that is described herein allows a user to select one or more page-ranges within an electronic document and to associate each the one or more page-ranges with a corresponding set of selected print attributes. In particular, by providing a multiple page-range interface window, the user can select multiple page-ranges throughout the document and associate specific print attributes that are to be applied to each of the corresponding page-ranges. In certain embodiments, the user is provided with a set of print attribute options that are based on the current configuration of the printing device. In one embodiment, the set of print attributes are dynamically updated if there is a change in the current configuration of the printing device. In addition, by providing a list of currently available media types, the user may select the specific media type that is to be used in printing a particular range of pages.

In describing certain embodiments of the invention, several drawing figures have been used for explanation purposes. However, the invention is not limited to any particular context as shown in drawing figures, and the scope of the invention includes other contexts and applications in which the preview document model described herein is available to other mechanisms, methods, programs, and processes. For example, the document printing system has been illustrated with a single printing device. However, embodiments of the invention are not limited to any particular number of printing devices which may each be configured to respond to document print requests from a plurality of different types of client devices.

In addition, certain types of printer characteristics have been provided as examples in describing the invention. However, embodiments of the invention are not limited to any particular type of printer characteristic. For example, in addition to the print attribute options described above, a user may also be presented with a set of color, fonts, pagination, signature layout or style attribute options that are supported by the selected printing device. Thus, the specification and drawings are, accordingly, to be regarded in an illustrative rather than a restrictive sense.

In addition, in this disclosure, including in the claims, certain process steps are set forth in a particular order, and alphabetic and alphanumeric labels are used to identify certain steps. Unless specifically stated in the disclosure, embodiments of the invention are not limited to any particular order of carrying out such steps. In particular, the labels are used merely for convenient identification of steps, and are not intended to imply, specify or require a particular order of carrying out such steps.

What is claimed is:

1. A method for printing an electronic document, the method comprising:

prior to transmitting, to the printing device, a set of first print information that identifies a first media type for printing one or more pages of said electronic document, displaying a user interface that identifies (a) a set of two or more media types that are currently available to a printing device for printing pages of the electronic document and (b) a set of two or more paper sources of said printing device;

prior to transmitting said set of first print information to said printing device, receiving first user input that selects said first media type from said set of two or more media types;

in response to receiving said first user input, and prior to transmitting said set of first print information to said printing device, determining a particular paper source that is mapped to said first media type, wherein said particular paper source contains media of said first media type;

in response to determining said particular paper source, and prior to transmitting said set of first print information to said printing device, automatically updating said user interface to indicate a selection of said particular paper source;

prior to transmitting said set of first print information to said printing device, and after automatically updating said user interface to indicate said selection of said particular paper source, receiving second user input that indicates that printing of said electronic document should begin using media of said first media type; and in response to receiving said second user input, transmitting said set of first print information to said printing device.

2. The method as recited in claim 1, further comprising the steps of:

receiving said set of first print information that identifies said first media type at said printing device; and generating at said printing device, a printed copy of one or more pages of said electronic document using said first media type.

3. The method of claim 1, wherein: the set of two or more media types includes a set of two or more media types that are available for printing pages of the electronic document; and the method further comprising the steps of, receiving input that selects a second media type from said set of two or more media types; and the step of transmitting further includes the step of transmitting to said printing device, a set of second print information that identifies said second media type for printing one or more pages of said electronic document.

4. The method as recited in claim 3, further comprising the steps of:

receiving said set of second print information that identifies said second media type at said printing device; and generating at said printing device, a printed copy of one or more pages of said electronic document using said second media type.

5. The method of claim 3, wherein the steps of transmitting said set of first and second print information includes the step of transmitting to said printing device, said set of first and second print information in a single print request.

6. A computer-readable medium carrying one or more sequences of instructions for printing an electronic document, wherein execution of the one or more sequences of instructions by one or more processors causes the one or more processors to perform:

prior to transmitting, to the printing device, a set of first print information that identifies a first media type for printing one or more pages of said electronic document, displaying a user interface that identifies (a) a set of two or more media types that are currently available to a printing device for printing pages of the electronic document and (b) a set of two or more paper sources of said printing device;

prior to transmitting said set of first print information to said printing device, receiving first user input that selects said first media type from said set of two or more media types;

in response to receiving said first user input, and prior to transmitting said set of first print information to said printing device, determining a particular paper source that is mapped to said first media type, wherein said particular paper source contains media of said first media type;

in response to determining said particular paper source, and prior to transmitting said set of first print information to said printing device, automatically updating said user interface to indicate a selection of said particular paper source;

prior to transmitting said set of first print information to said printing device, and after automatically updating said user interface to indicate said selection of said particular paper source, receiving second user input that indicates that printing of said electronic document should begin using media of said first media type; and in response to receiving said second user input, transmitting said set of first print information, transmitting said set of first print information to said printing device.

7. The computer-readable medium as recited in claim 6, further comprising instructions for performing the steps of:

receiving said set of first print information that identifies said first media type at said printing device; and generating at said printing device, a printed copy of one or more pages of said electronic document using said first media type.

8. The computer-readable medium of claim 6, wherein:

the set of two or more media types includes a set of two or more media types that are available for printing pages of the electronic document; and the computer-readable medium further comprising instructions for performing the steps of, receiving input that selects a second media type from said set of two or more media types; and the step of transmitting further includes the step of transmitting to said printing device, a set of second print information that identifies said second media type for printing one or more pages of said electronic document.

9. The computer-readable medium as recited in claim 8, further comprising instructions for performing the steps of:

receiving said set of second print information that identifies said second media type at said printing device; and generating at said printing device, a printed copy of one or more pages of said electronic document using said second media type.

10. The computer-readable medium of claim 8, wherein the steps of transmitting said set of first and second print information includes the step of transmitting to said printing device, said set of first and second print information in a single print request.

11. A system for printing an electronic document, comprising:

one or more processors;

one or more memories coupled to the one or more processors; and one or more sequences of instructions stored in the one or more memories, wherein execution of the one or more sequences of instructions by one or more processors causes the one or more processors to perform the steps of:

prior to transmitting, to the printing device, a set of first print information that identifies a first media type for printing one or more pages of said electronic document, displaying a user interface that identifies (a) a set of two or more media types that are currently available to a printing device for printing pages of the electronic document and (b) a set of two or more paper sources of said printing device;

prior to transmitting said set of first print information to said printing device, receiving first user input that selects said first media type from said set of two or more media types; in response to receiving said first user input, and prior to transmitting said set of first print information to said printing device, determining a particular paper source that is mapped to said first media type, wherein said particular paper source contains media of said first media type;

in response to determining said particular paper source, and prior to transmitting said set of first print information to said printing device, automatically updating said user interface to indicate a selection of said particular paper source;

prior to transmitting said set of first print information to said printing device, and after automatically updating said user interface to indicate said selection of said particular paper source, receiving second user input that indicates that printing of said electronic document should begin using media of said first media type; and in response to receiving said second user input, transmitting said set of first print information to said printing device.

* * * * *